US006780058B2

(12) United States Patent
Mizumura et al.

(10) Patent No.: US 6,780,058 B2
(45) Date of Patent: Aug. 24, 2004

(54) SHIELDED BACKPLANE CONNECTOR

(75) Inventors: Akinori Mizumura, Yamato (JP); Atsuhito Noda, Hachioji (JP); Yoshihiro Tetsuka, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/399,526

(22) PCT Filed: Oct. 17, 2001

(86) PCT No.: PCT/US01/32506

§ 371 (c)(1),
(2), (4) Date: Apr. 17, 2003

(87) PCT Pub. No.: WO02/33789

PCT Pub. Date: Apr. 25, 2002

(65) Prior Publication Data

US 2004/0005815 A1 Jan. 8, 2004

(30) Foreign Application Priority Data

Oct. 17, 2000 (JP) ..... 2000-316666

(51) Int. Cl.[7] ..... H01R 13/648
(52) U.S. Cl. ..... 439/608
(58) Field of Search ..... 439/608, 607, 439/108, 101

(56) References Cited

U.S. PATENT DOCUMENTS 5,104,341 A 4/1992 Gilissen et al. ..... 439/608
5,174,764 A 12/1992 Kandybowski et al. ..... 439/83
5,904,594 A 5/1999 Longueville et al. ..... 439/608
6,428,358 B1 * 8/2002 Figueroa et al. ..... 439/608
6,443,745 B1 * 9/2002 Ellis et al. ..... 439/101
6,461,202 B2 * 10/2002 Kline ..... 439/701
6,602,095 B2 * 8/2003 Astbury et al. ..... 439/608
6,607,402 B2 * 8/2003 Cohen et al. ..... 439/608
6,612,869 B1 * 9/2003 Billman ..... 439/608
6,699,073 B1 * 3/2004 Wu ..... 439/608

* cited by examiner

*Primary Examiner*—Gary Paumen
(74) *Attorney, Agent, or Firm*—Thomas D. Paulius

(57) ABSTRACT

A plug connector (10) to be actually mounted on one substrate K1 and a receptacle connector (20) to be actually mounted on the other substrate K2 are provided. The receptacle connector is provided with a housing (22) into which the plug connector is to be inserted ad a plurality of pin terminals (23) arranged in an array to the housing. The plug connector is provided with a plurality of contacts (12) having contact pieces (11) in electrical contact with the respective pin terminals and a housing (13) for holding the respective contacts. A plurality of vertical shield plates (27) are provided between the respective pin terminals in the receptacle connector. A plurality of horizontal shield plate (14) are provided to intersect with the vertical shield plates (27) in a cruciform manner within said plug connector. Slits for advancing the vertical shield plates are formed in the housing of the plug connector and the horizontal shield plate (14).

14 Claims, 11 Drawing Sheets

SHIELDED BACKPLANE CONNECTOR

REFERENCE TO RELATED APPLICATIONS

This application claims priority from International Patent Application No. PCT/US01/32506, filed Oct. 17, 2001, which claims priority from Japanese Patent Application No. 2000-316666, filed Oct. 17, 2000

BACKGROUND OF THE INVENTION

The present invention relates to a backplane connector assembly for electrically connecting circuit boards together and a method for producing the plug connector component of the connector assembly.

A connector for connecting two circuit boards together has been frequently used for the purpose of enhancing an actually mounted density of the electronic circuits or for the purpose of arranging a plurality of circuit boards in a solid state in conformity with the miniaturization or reduction in size of electronic equipment.

In general, this type connector is composed of a plug connector and a receptacle connector. The plug connector is to be connected to one of the circuit boards and the receptacle connector is to be connected to the other circuit board. The types of connection between the two circuit boards using such a connector may be generally categorized into two. One type is that both connectors are clamped by a pair of circuit boards under the condition that the circuit boards are overlapped and connected to each other. The other type is where the surface of one circuit board is intersected substantially perpendicular with the surface of another circuit board when both connectors are connected to each other.

For instance, the latter substrate connecting connector is disclosed in Japanese Patent Application Laid-Open No. Hei 8-288019 and Japanese Patent Application Laid-Open No. Hei 10-172652.

In case of this type of backplane connector, there are the following tasks to be solved in view of the fact that a multi-pin connector having a large number, from several tens to several hundreds, of terminals is used recently, the connector becomes a high speed transfer connector and so on.

The first problem is that of providing effective electromagnetic shielding of signal terminals. Even in a conventional backplane connector, there are some cases where a partial approach is effected in regard to electromagnetic shielding. However, such an approach is not satisfactory. For instance, there is a receptacle connector in which a plurality of rows of signal terminals (signal pins) are provided in a widthwise direction of the connector housing, and a plurality of stages thereof are provided in a thickness, or vertical, direction of the housing. In this connector, shielding plates are arranged simply in the widthwise direction of the housing and separated from each other at designated intervals. For this reason, there is a problem of cross-talk between the signal terminals in the areas where no shielding plates are provided.

The second problem is in the manufacturing equipment and manufacturing cost of the plug connector. For instance, in a plug connector provided with a number of contacts arranged in a grid of 25 pins (widthwise) and 5 pins (height or vertically) of the plug housing, a method is carried out in which this large number of contacts, or terminals, are sequentially press fitted into the mounting holes of the connector housing in groups. In this case, the terminals and the shielding plates are alternatively press fitted, but because the shielding plates are inserted in the vertical direction, only one vertical columns of five terminals can be press fit vertically at once. As a result, the press fit steps for the terminals and the press fit steps for the shielding plates have each to be performed twenty-five times, for the terminal columns and vertical shielding plates, respectively, i.e., fifty times in total. Correspondingly, the manufacturing equipment becomes worn over time and also the manufacturing cost increases. Of course, also in this case, the above-described problem of electromagnetic shielding is still unresolved.

The present invention is directed to a backplane connector construction that overcomes the aforementioned disadvantages.

SUMMARY OF THE INVENTION

It is therefore a general object of the present invention to provide an improved backplane connector for solving the problem of the shielding of the connector and the problem of cross-talk or the like.

Another object of the present invention is to provide a technology to remarkably reduce the press inserting step of the terminals, thereby enhancing the connector manufacturing equipment and to make it possible to reduce the manufacturing cost.

These and other objects and advanatages are accomplished by way of the structure of the invention.

In accordance with the principles of the present invention, a backplane connector for electrically connecting together two circuit boards, or backplanes, together is provided with a plug connector for mounting on one circuit board and a receptacle connector for mounting on the other circuit board. The receptacle connector is provided with a housing having an opening into which the plug connector may be inserted, and it includes a plurality of male terminals arranged in a grid within the receptacle housing. The plug connector is provided with a plurality of female terminals, each terminal having a contact portion for electrically contacting the respective male terminals of the receptacle connector, and an insulative housing for holding the terminals in place. A plurality of vertical shielding plates to be arranged in parallel with each other are provided between the respective pin terminals in the receptacle connector. A plurality of horizontal shielding plates are arranged in spaced apart horizontal rows and are provided to intersect with the vertical shielding plates in a cruciform manner, within the body of the plug connector. Slits for receiving the vertical shielding plates are respectively formed in the housing of the plug connector and in the horizontal shielding plates.

According to the present invention, since the plurality of horizontal shielding plates are arranged generally in parallel with each other in the plug connector so as to intersect with the vertical shielding plates on the receptacle side in a cruciform manner, it is possible to make a form in which the shielding plates are present and adjacent to every signal terminal. Thus, it is possible to solve problem of the electromagnetic shielding of the connector and there is no problem of cross-talk or the like.

According to the present invention, when each of the pin terminals of the receptacle connector and the contact portions of the plug connector terminals are electrically connected to each other, the periphery of the respective contacts areas of the two connector terminals are surrounded by both vertical and the horizontal shielding plates of the two connectors and thus prevention of cross-talk is more ensured.

The housing of the plug connector according to the present invention is preferably composed of a plurality of insulative housing modules that are overlapped in a plurality of stages in a thickness direction (vertically) of the housing and are connected to each other, and the horizontal shielding plates are respectively interposed between the housing modules. With such a structure in which the plurality of the housing modules are overlapped in the plurality of stages in the thickness direction of the housing, it is possible to reduce the number of the housing modules. Furthermore, the horizontal shielding plates are disposed between adjacent housing modules so that the plurality of horizontal shielding plates may readily be provided.

It is also preferable that mounting holes, or passages, for the terminals are arranged at intervals widthwise of the housing modules and the slits are provided between adjacent terminal-mounting passages in the respective housing modules. The slits are provided between the adjacent mounting passages of the housing modules so that each shielding plate of the receptacle connector may be inserted into the plug connector body portion between adjacent mounting passages thereof.

It is preferable that engagement portions are provided on the housing modules so they will engage adjacent housing modules. With these engagement portions, it is possible to readily and detachably engage the housing modules together without permanently adhering the housing modules together.

It is also preferable that each housing module is provided with a plurality of terminal assemblies with contact portions that are press-fit into each mounting hole and tail portions that extend out of the module for connecting the terminals to the circuit board. With such an arrangement, it is possible to insert the terminal assemblies into the housing modules as a horizontal group so that a large number of terminal assemblies corresponding to one lateral, or horizontal, row of the plug connector may be press-fit simultaneously, rather than being limited to individual insertions of vertical columns of terminal assemblies.

It is preferable that the a portion of the terminal assembly is molded of resin or plastic except for the contact and tail portions. With such a resin molded portion, it is possible to keep each terminal in an electrically insulated condition while maintaining the terminals in one piece under the one lateral row condition.

It is preferable that a length dimension of each of the housing modules is substantially the same, a length dimension of the terminal assemblies located in an upper module is longer than a length dimension of the terminal assemblies located in a lower module, and the tail portions are bent at a right angle relative to the contact portions so that the tail portions are directed downwardly. With such an arrangement, it is easy to perform the soldering work when the plug connector is actually mounted on the circuit board. This is a suitable embodiment as the plug connector of the backplane connector where the circuit boards are at right angles to each other. It is also preferable that the molded portion of the terminal assemblies is formed to be bent substantially at a right angle as viewed in side elevation Thus, it is possible to realize the positioning work of the tail portions directed downwardly with the resin molded portion that may readily be manufactured.

On the other hand, a method for producing a plug connector according to the present invention uses a plurality of housing modules connectable with each other in a plurality of horizontal stages, with a horizontal shielding plate provided between each pair of adjacent housing modules, and terminal assemblies connected to the rear end of each of the housing modules, and comprises the following first through fifth steps: a first step of press fitting a first contact terminal assembly from a rear end side of the lowermost first housing module under the condition that the horizontal shield plate is slid onto on the first housing module; a second step of bending downwardly a rear portion of said horizontal shielding plate; a third step of overlapping a second housing module on the horizontal shielding plate of the first housing module and connecting it to the first housing module; a fourth step of press-fitting the second terminal assembly from a rear end side of the second housing module under the condition that another horizontal shielding plate is slid onto the second housing module; and, a fifth step of bending downwardly a rear portion of the second horizontal shielding plate.

According to the manufacturing method of the present invention, the plurality of housing modules are connectable with each other in the plurality of laminated stages, the horizontal shielding plates are provided between the adjacent housing modules, and the terminal assemblies are inserted through a rear end side of each of the housing modules. In the assembling work, because the upper stage housing module is overlapped and coupled through the horizontal shield plate to the lower housing module, it is possible to press insert all the terminals in one lateral row simultaneously. Accordingly, the press-fitting steps of the terminals corresponds to the number of the laminate stages of the plug connector housing. For instance, if the number of the laminate stages is five, the step of press-fitting the terminals will be repeated only five times. Thus, it is possible to considerably reduce the steps of press-fitting the terminals to thereby enhance the manufacturability and reduce the manufacture cost of the connector.

It is preferable that a step where each horizontal shield plate is provided on each housing module is performed in advance. Thus, it is possible to reduce the number of the steps of assembling corresponding to this.

It is preferable that mounting passages for the terminal assemblies are arranged at an interval in a widthwise direction of the housing modules and the slits are provided between the adjacent mounting holes. The slits are thus provided between the adjacent mounting holes so that each vertical shield plate of the receptacle connector may be inserted between the adjacent mounting holes.

It is preferable that a male-type engagement portion and a female-type engagement portion be provided for engaging with each other and for coupling the housing modules together along adjoining surfaces of the adjacent housing modules. Thus, it is possible to make the assembling work extremely convenient by assembling the housing modules in laminate in order.

It is preferable that each terminal assembly is provided with a contact portion to be press inserted into each mounting hole and a tail portion that is a lead-out conductive member for connecting each tail portion to the circuit board and the terminal assembly is molded of resin except for said contact and tail portions. With such a resin molded portion, it is possible to keep each contact in an electrically insulated condition while maintaining the terminals in one piece under the one lateral row condition. Furthermore, it is possible to keep the terminal assemblies in the electrically insulated condition from each other.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
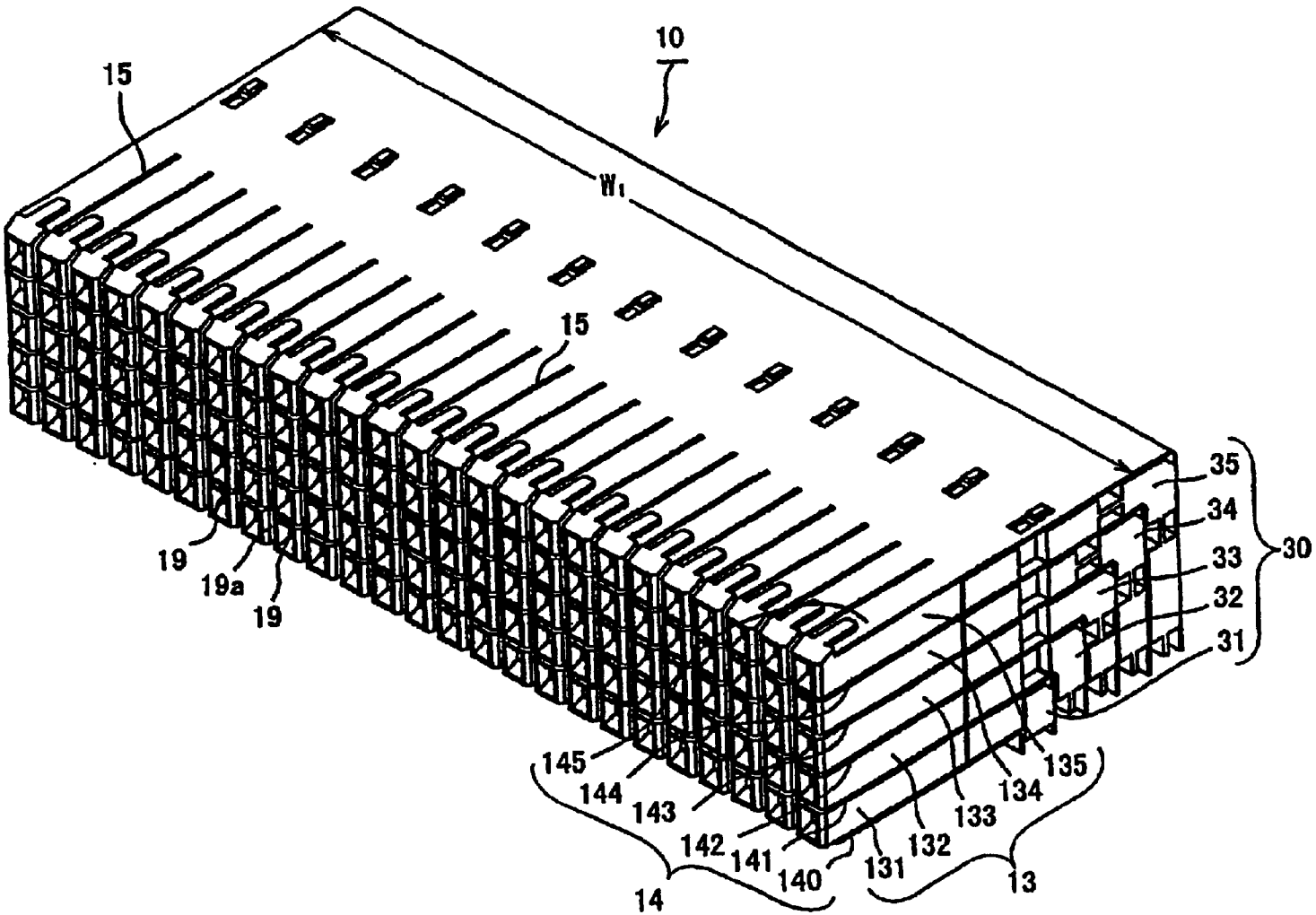
FIG. 1 is a perspective view showing a plug connector assembled from connector modules according to the present invention.
Figure 2:
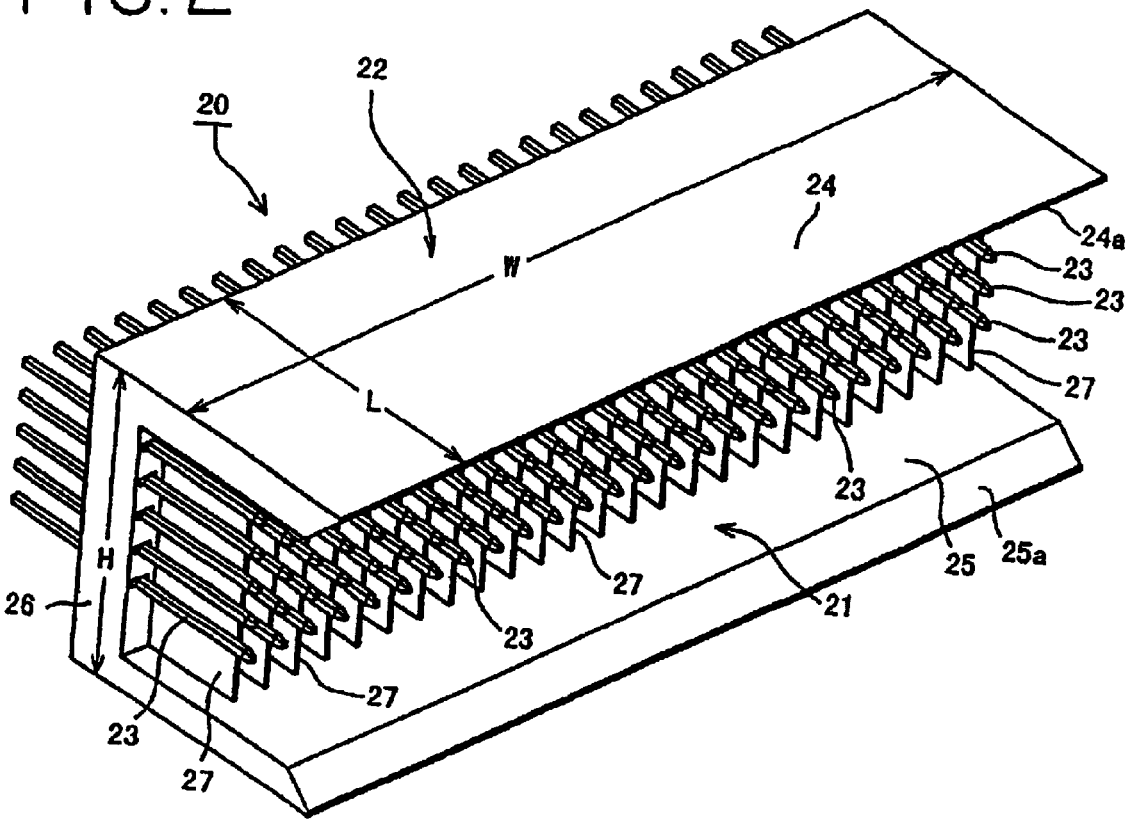
FIG. 2 is a perspective view showing a receptacle connector according to the present invention.
Figure 4:
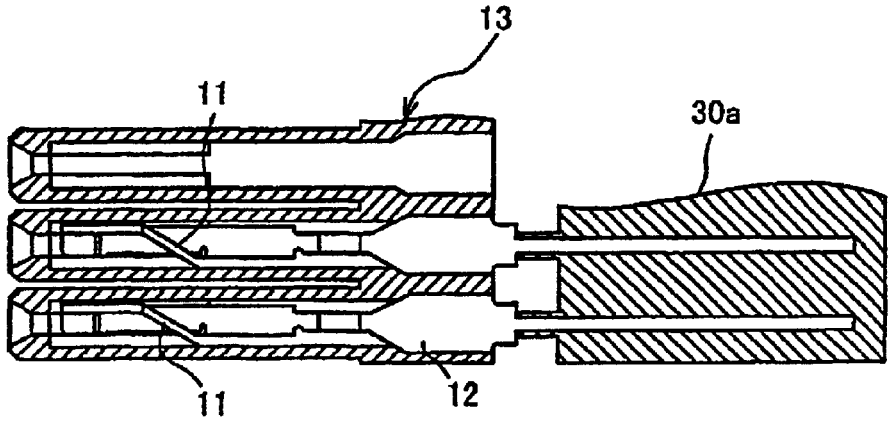
FIG. 4 is a cross-sectional view showing a primary part of the plug connector.
Figure 3:
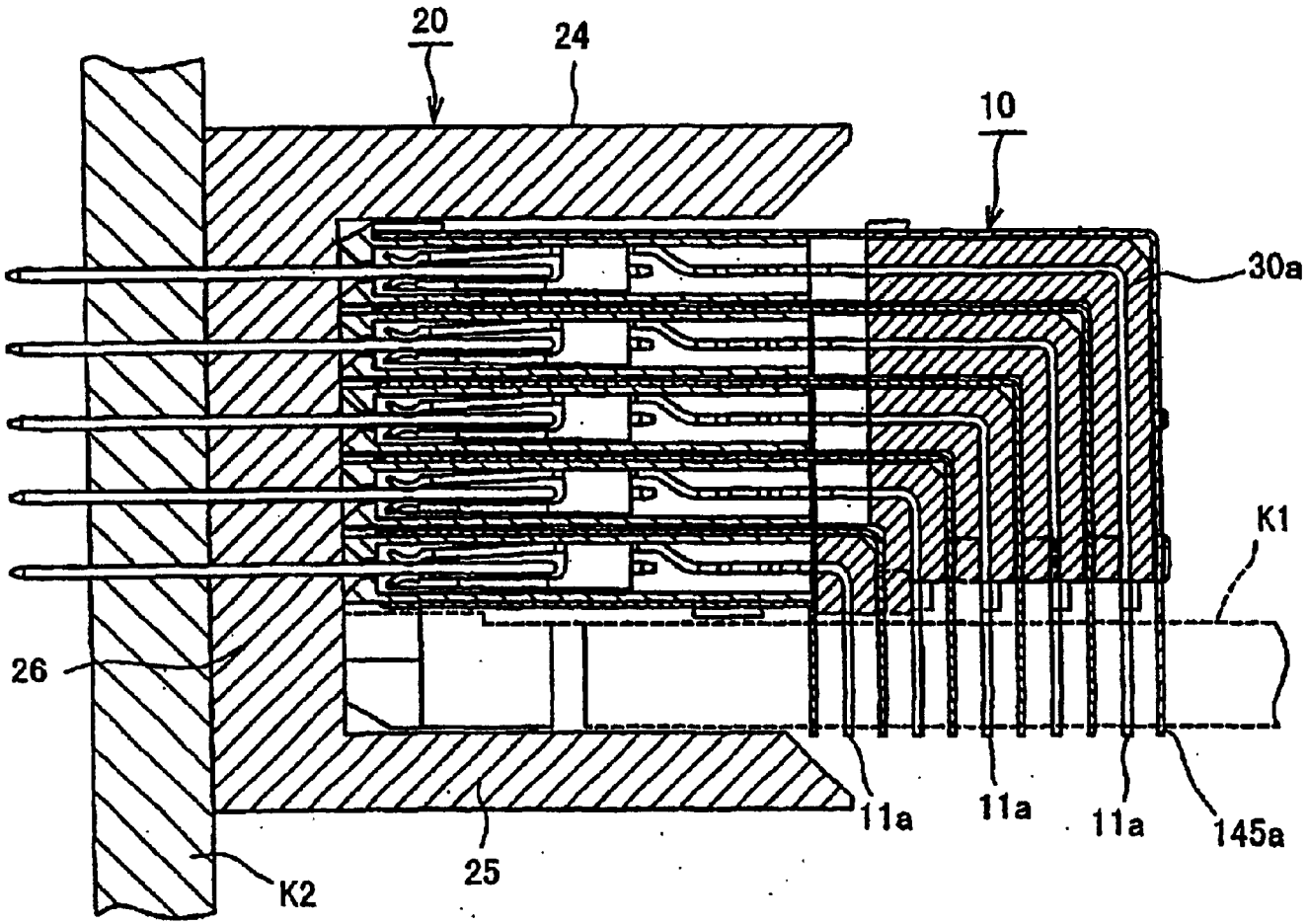
FIG. 3 is a vertical sectional view illustrating the plug and receptacle connectors of FIGS. 1 and 2 mated together.
Figure 5:
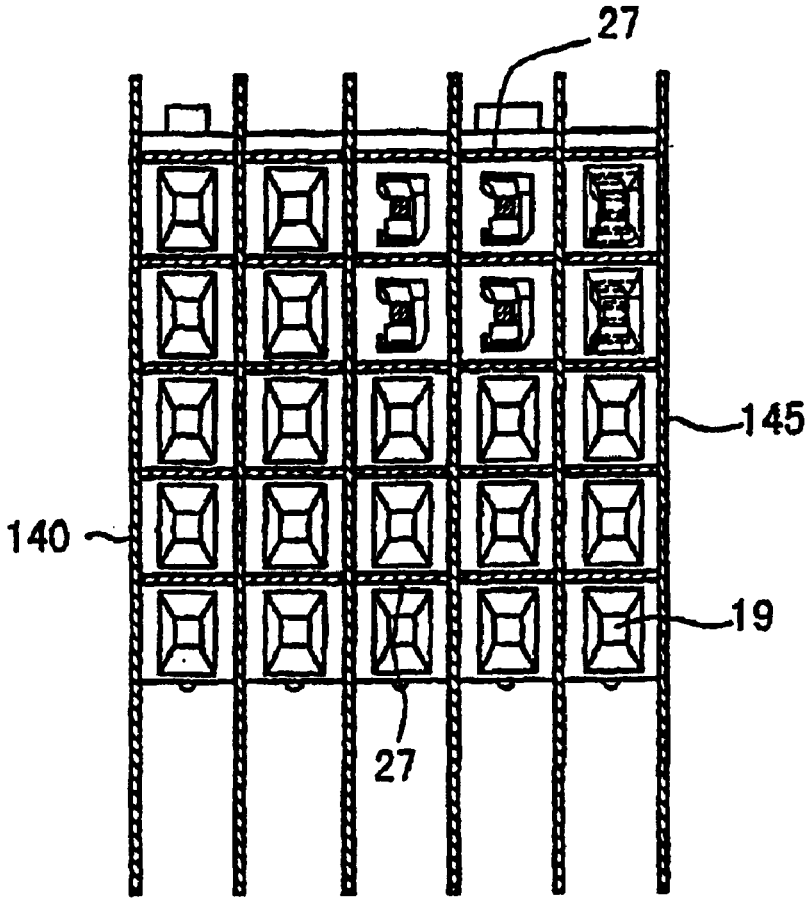
FIG. 5 is a cross-sectional view of the plug connector taken widthwise of a primary part under a coupling condition.

FIG. 1 is a perspective view of a plug connector according to the present invention. FIG. 2 is a perspective view of a receptacle connector. FIG. 3 is a cross-sectional view showing a condition in which the plug connector and the receptacle connector are actually mounted on the circuit boards K1, K2 and are connected to each other.

This embodiment shows an example in which the present invention is applied to a backplane connector disposed between circuit boards that intersect each other with the boards kept at a right angle, i.e., a so-called L-shaped connection for electrically connecting the circuit boards to each other. As shown in FIG. 3, this backplane connector is provided with a plug connector 10 actually mounted on a surface of one of the circuit boards K1 and a receptacle connector 20 actually mounted on a surface of the other circuit board K2.

As shown in FIG. 2, the receptacle connector 20 is provided with an insulative housing 22 having an opening 21 into which the plug connector 10 is to be inserted and a plurality of pin terminals 23 arranged in a grid relative to the housing 22. The housing 22 is shaped in a U-shape or a C-shape as viewed in elevation and is provided with an upper plate 24, a bottom plate 25 and a rear plate 26. The housing 22 is formed so that its width W is greater than its height H and its length L. Accordingly, in the embodiment shown, the pin terminals 23 are arranged in five stages in height direction of the housing 22 and twenty-five rows in the widthwise direction, i.e., with 125 pieces in total. All the pin terminals 23 are formed into rectangular pins.

The housing 22 as a whole is preferably molded of insulative resin. All the pin terminals 23 pass through the rear plate 26 of the housing 22. Thus, each pin terminal 23 is kept in the electrically insulated condition from others. Guide slant surfaces 24*a* and 25*a* may be formed in the upper plate 24 and the bottom plate 25 of the housing 22 for facilitating the insertion of the plug connector 10.

A plurality of vertical shielding plates 27 that define the receptacle connector shields are provided for the receptacle connector at an equal interval widthwise within its associated housing 22. Each vertical shielding plate 27 includes a rectangular planar shape and arranged widthwise in the housing 22, between adjacent rows of pin terminals 23, 23. Each vertical shielding plate 27 is arranged vertically in the connector housing so that it divides the receptacle connector in terms of rows of every five pins in the vertical row by the vertical shielding plates 27 (clamped by the vertical shielding plates on both sides). Each pin terminal 23 has the same length and is longer than the length dimension of the vertical shielding plates 27.

Figure 6:
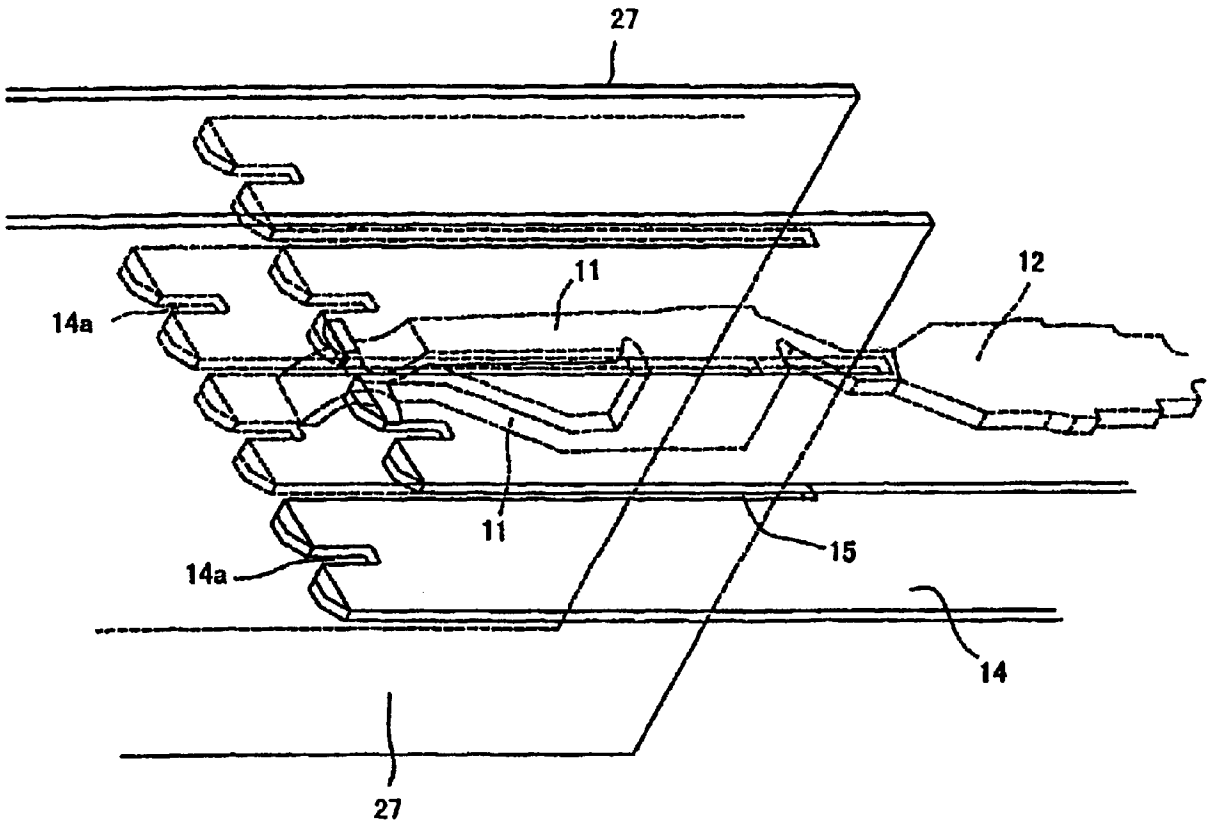
FIG. 6 is a partially perspective view with the shielding plates and terminal in isolation illustrating the relationship between a vertical shield plate, terminal and horizontal shielding plate.

The plug connector 10 is provided with a plurality of conductive terminals 12 each having a contact portion (FIG. 6) that electrically contacts the associated pin terminal 23 of the receptacle connector 20, when the plug and receptacle connector are engaged together. The terminals 12 are arranged within an overall insulative connector housing 13. A plurality of horizontal shielding plates 140 to 145 are arranged in the connector housing, preferably parallel to each other to define an overall plug connector shield 14, and these horizontal shielding plates intersect with the vertical shielding plates 27 of the receptacle connector in a cruciform manner within the body of the plug connector 10. Slits 15 are provided in the housing 13 of the plug connector 10 and the overall plug shield 14 that receive the receptacle connector vertical shielding plates 27 in the plug connector body.

The housing 13 of the plug connector 10 is composed of a plurality (five stages being illustrated in the drawings) of individual housing modules 131 to 135 that are overlapped in a purality of stages in the thickness (vertical) direction of the plug connector housing 13 thereof and which are coupled, or engaged, with each other. First through fourth horizontal shielding plates 141 to 144 are interposed between the adjacent housing modules 131 to 135, and horizontal shielding plates 145 and 140 are disposed on the upper and lower portions of the housing 13 in order to provide the plug connector with its own associated shield arrangement 14.

Figure 9:
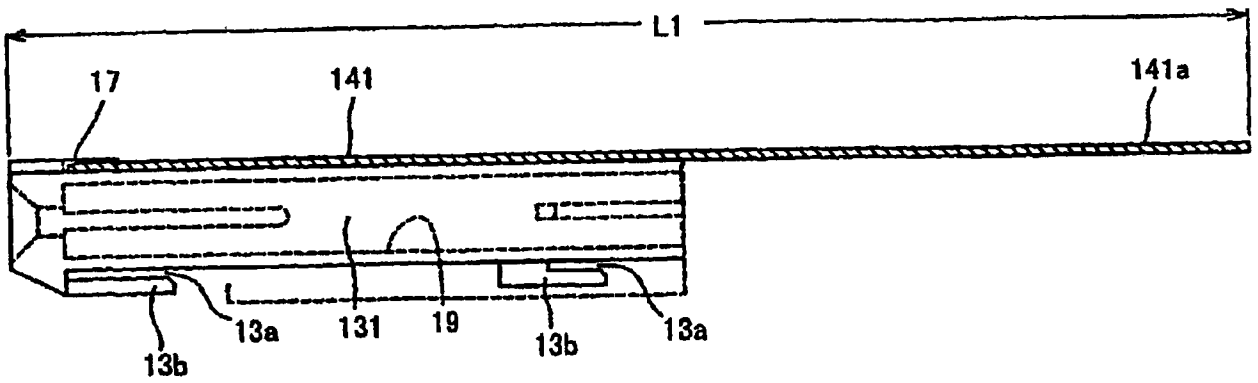
FIG. 9 is a cross-sectional view of a plug connector module showing the first assembly thereof.

These horizontal shielding plates 140 to 145 are arranged laterally (horizontally) within the plug connector, and their flat surface area is greater than that of the vertical shielding plates 27. Furthermore, the flat surface area of each horizontal shielding plate 140 to 145 is different from each other as described later. The surface area thereof is increased from the lower stage to the upper stage of the housing modules arranged within the plug connector body. In a more specific form, the respective horizontal shielding plates 140 to 145 have the same width dimension W1, but different length dimension L1 (FIG. 9). This may readily be understood from the reason to be described later.

Figure 7:
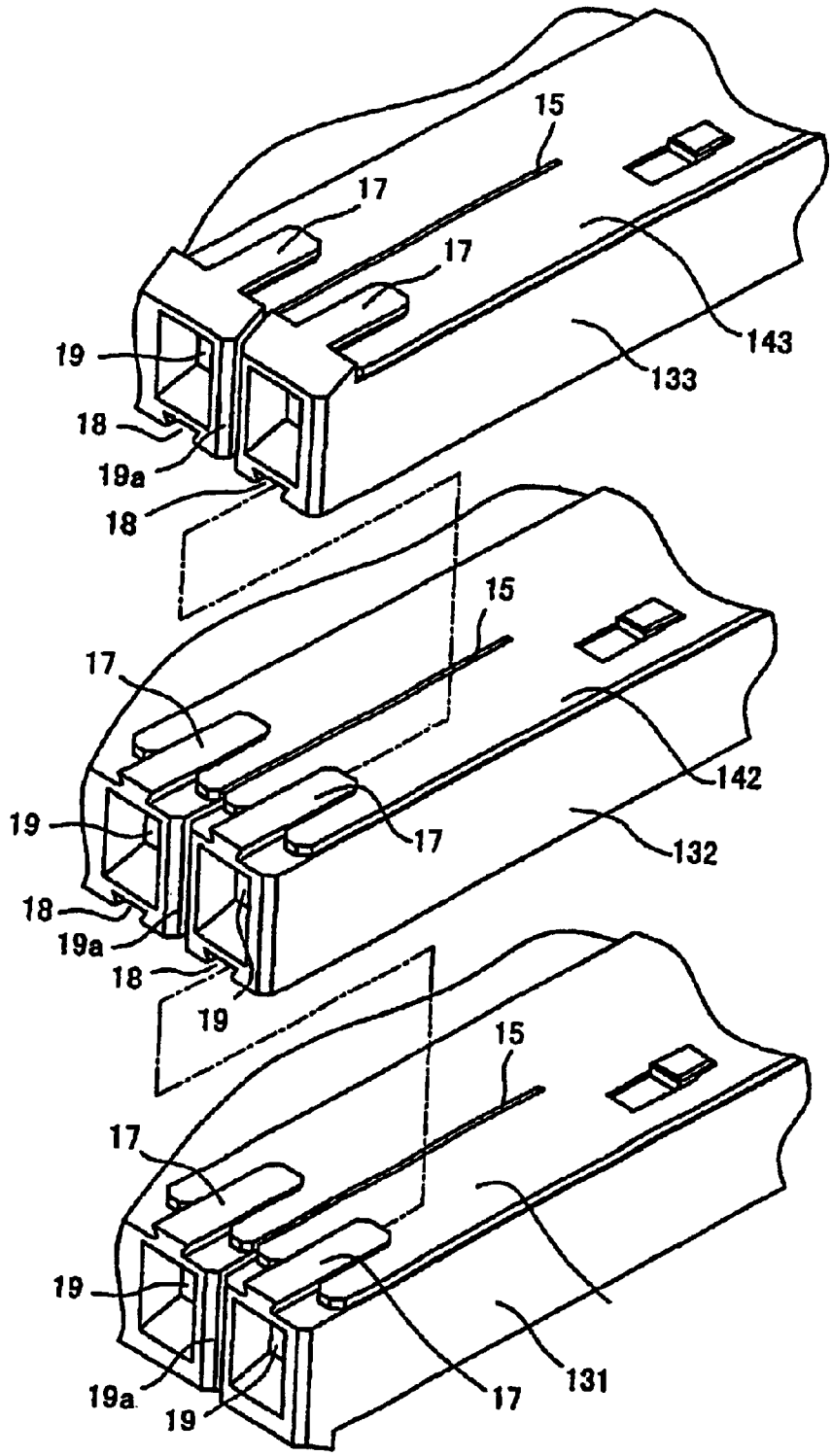
FIG. 7 is all exploded perspective view of a series of housing modules of the plug connector.

As shown in FIG. 7, male-type engagement portions, such as lugs or tabs, 17 and female-type engagement portions, such as notches or slots, 18 for engaging with each other to thereby couple the housing modules with each other are provided in adjoining (or opposing) surfaces of the housing modules. The male engagement portions 17 are preferably provided on the top surfaces of the housing modules 131 to 135 and the female engagement portions 18 are formed on the lower surfaces thereof, preferably proximate to the front ends thereof. These engagement portions are coupled or engaged together in a "wedge-type" system. As shown in FIG. 7, this engagement is preferably made by sliding one housing module across another housing module from the rear ends thereof.

It should be noted that the male engagement portions 17 have such a height sufficient so that not only do the horizontal shielding plates 140 to 145 engage the lugs 17, but also the female engagement portions 18 of the housing modules. Accordingly, cutaway portions in the form of slots or channels 14*a* (FIG. 6) are provided in each horizontal shielding plate 140 to 145 for engaging with the male type engagement portions 17.

A clip 40 may also be provided in each of the joining surfaces of the housing modules and this clip 40 is located so as to engage an opening 40 formed in the horizontal shielding plates. In this way, the housing modules 131 to 134 engage both shield plates 141 to 144 and adjacent housing modules 132 to 135 at the tabs 17. Moreover, the slits 19*a* of the each housing unites 131 to 134 and the slits 15 of each of the shielding plates 141 to 145 are aligned with each other by the tabs 17 and/or clips 40.

As shown in FIG. 7, each of the shielding plates 141 to 145 have disposed therein, fingers 43 that are defined by the slits 15. These fingers 43 have a length sufficient to fit between those portions of the plug connectors (and housing modules) where the vertical shielding plates 27 are inserted upon mating of the plug and receptacle connectors together. Mounting passages 19 for the terminals 12 are arranged at intervals along the width of the housing modules 131 to 135. A slit 19*a* is formed on opposite sides of each adjacent mounting passage 19.

The plug connector 10 is further provided with a plurality of terminal assemblies 30 (that means the terminal assemblies as a whole) to be connected to the rear end side of each housing module 131 to 135. In this case, first to fifth terminal assemblies 31 to 35 are provided and illustrated. Each terminal assembly 30 has a contact portion 11 that is press fit into each mounting passage 19 and a tail portion 11*a* that includes a conductive lead for connecting each terminal 12 to the circuit board K1. The terminal assembly 30 has an insulative retainer portion 30*a* that is molded for a resin for example, except for the contact portion 11 and the tail portion 11*a* of the terminal 12. With the retainer portion 30*a* being formed of a molded material, each terminal 2 is kept in the electrically insulative condition while maintaining each terminal in one piece in one lateral row.

Figure 8:
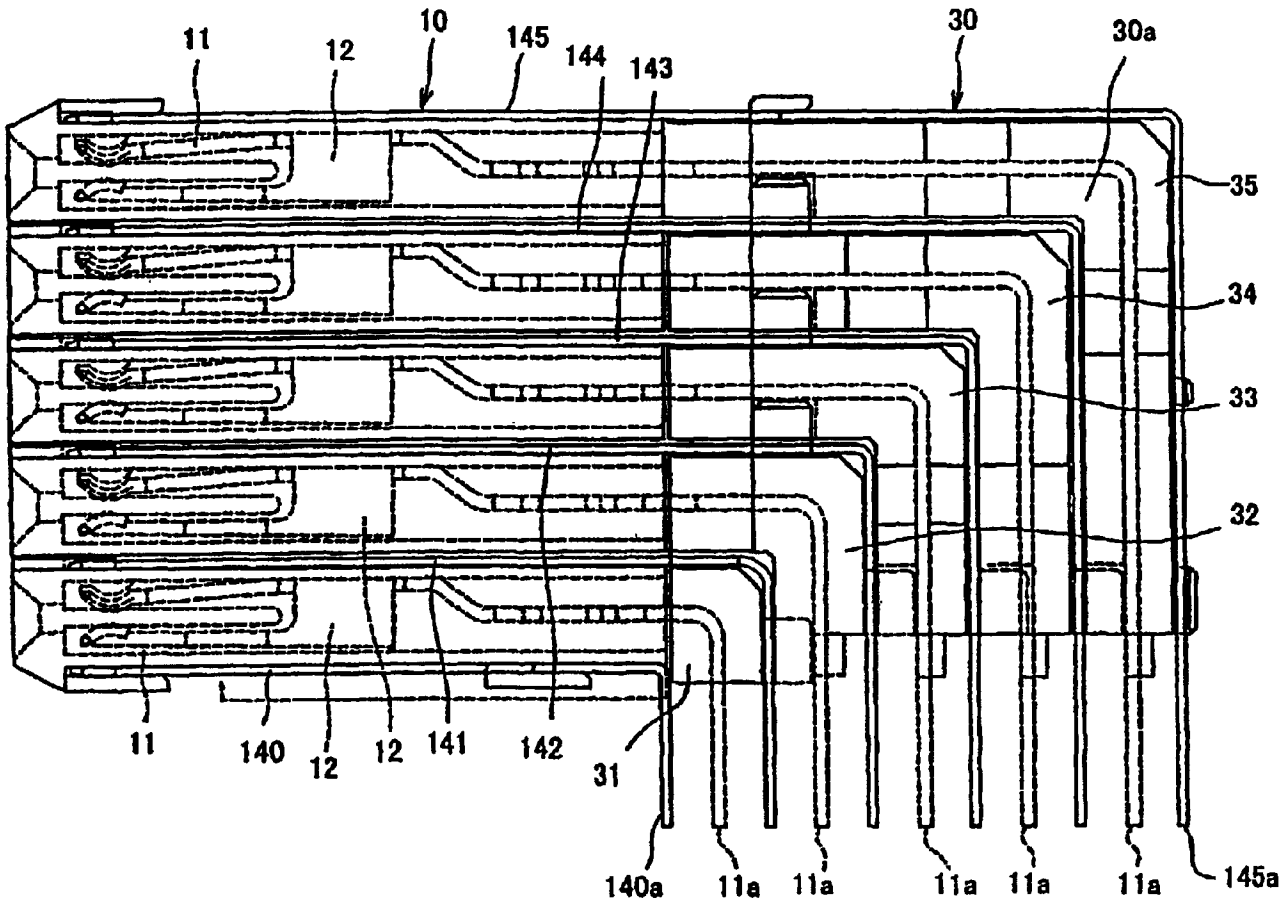
FIG. 8 is a cross-sectional view taken through lines 8—8 of the plug connector at FIG. 1.

As shown in FIG. 8, the length dimension of each housing module 13 is formed substantially the same. However, the length dimension of each contact assembly 30 is set so that the terminal assembly 32 located in the upper stage (housing module) is longer than the terminal assembly 31 located in the lower stage (housing module). This is because the tail portion 11*a* is bent substantially at a right angle relative to the contact portion 11 so that the tail portion 11*a* is directed downwardly (toward the surface of the substrate K1) and under this condition, the respective contact assemblies 30 are arranged to overlap in order. With such a structure, it is easy to perform soldering work when the plug connector 10 is to be actually mounted to the circuit board K1. Accordingly, as shown in FIG. 3, this is suitable as the plug connector of the backplane connector where the circuit boards K1 and K2 intersect with each other.

In order to bend the tail portion 11*a* substantially at a right angle relative to the contact portion 11, the retainer portion 30*a*, resin molded, of the terminal assembly 30 is molded and bent substantially at a right angle as viewed in elevation. Thus, the positioning work of directing the tail portion 11*a* downwardly may readily be performed with a high precision with the retainer portion 30*a* molded of resin that is superior in manufacturability.

An example of the method for manufacturing this plug connector 10 will now be described with reference to FIGS. 8–15. The plurality of housing modules that are the constituents for the housing 13 of the plug connector 10, the plurality of horizontal shielding plates 140–145 constituting the plug side shield 14 and the plurality of terminal assemblies are prepared, respectively, in advance. Namely, the first to fifth housing modules 131 to 135 that may be overlapped in the plurality of stages and coupled with each other, the six horizontal shielding plates 140 to 145 provided on the upper and lower surfaces of each housing 13, and the five contact assemblies 31 to 35 connected to the rear end side of each housing module are prepared and thereafter, the following assembling steps will be performed.

Figure 10:
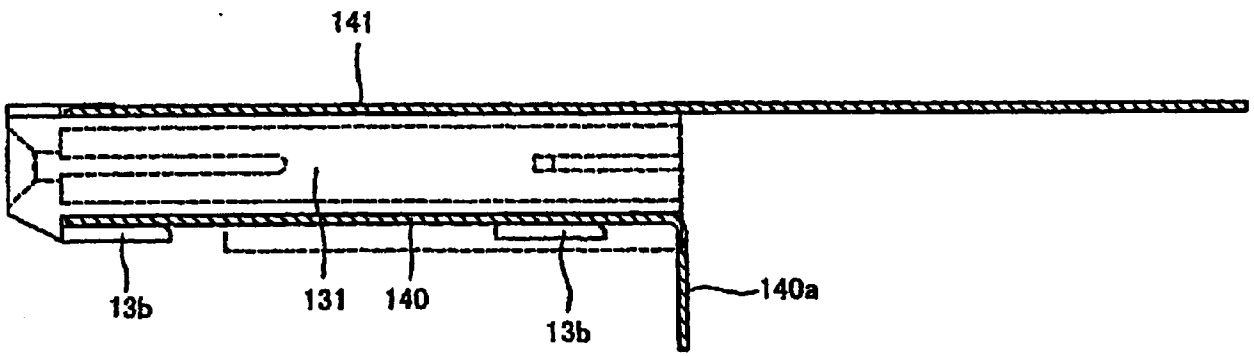
FIG. 10 is the same view as FIG. 9, but showing the second assembly step thereof.
Figure 11:
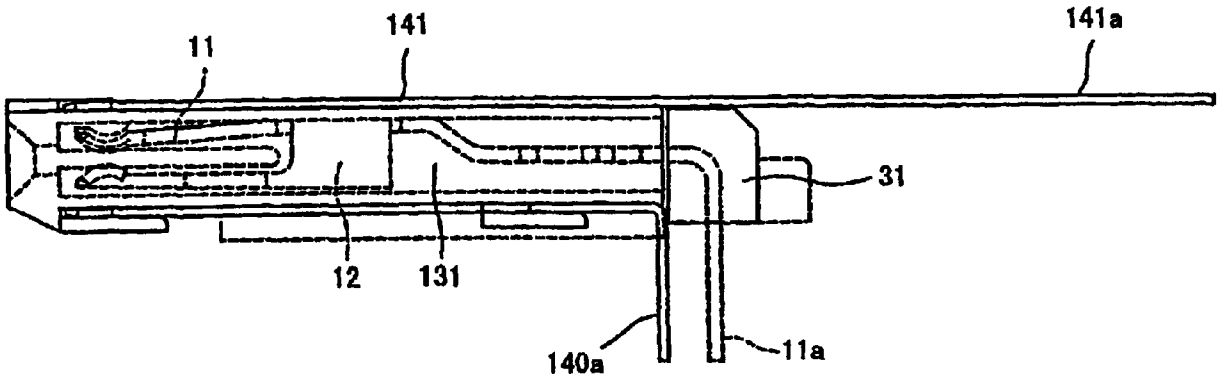
FIG. 11 is the same view as FIG. 10, but showing the assembly of the terminal into the module.

As shown in FIG. 9, in the first step, the horizontal shielding plate 141 is overlapped on the upper surface side of the lowermost fist housing module 131 and the cutaway portions 14*a* are engaged with the male type engagement portions 17 and positioned in place. Subsequently, as shown in FIG. 10, the horizontal shielding plate 140 is mounted on the lower surface side of the first housing module 131, and the rear end portion 140*a* thereof is bent downwardly substantially at a right angle. Furthermore, under this condition, the first terminal assembly 31 is press fit from the rear end side of the first housing module 131 and connected thereto (FIG. 11).

Incidentally, the mounting structure of the horizontal shielding plate 140 to the lower surface side of the first housing module 131 is somewhat different. A plurality of support projections 13*b* are provided with insertion slits 13*a* defined in between the lower surface of the first housing module 131. Accordingly, the horizontal shielding plate 140 is inserted and mounted into the insertion slits 13*a*. Namely, holes (not shown) corresponding to the insertion slits 13*a* and the support projections 13*b* are provided also in the horizontal shield plate 140.

Figure 12:
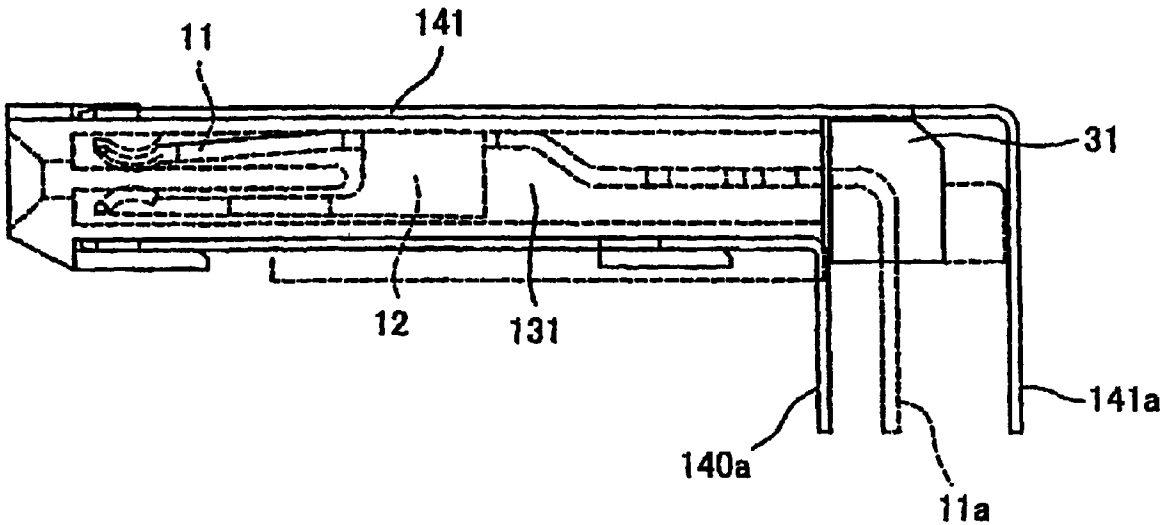
FIG. 12 is the same view as FIG. 11 but showing the bending of the top shield portion.
Figure 13:
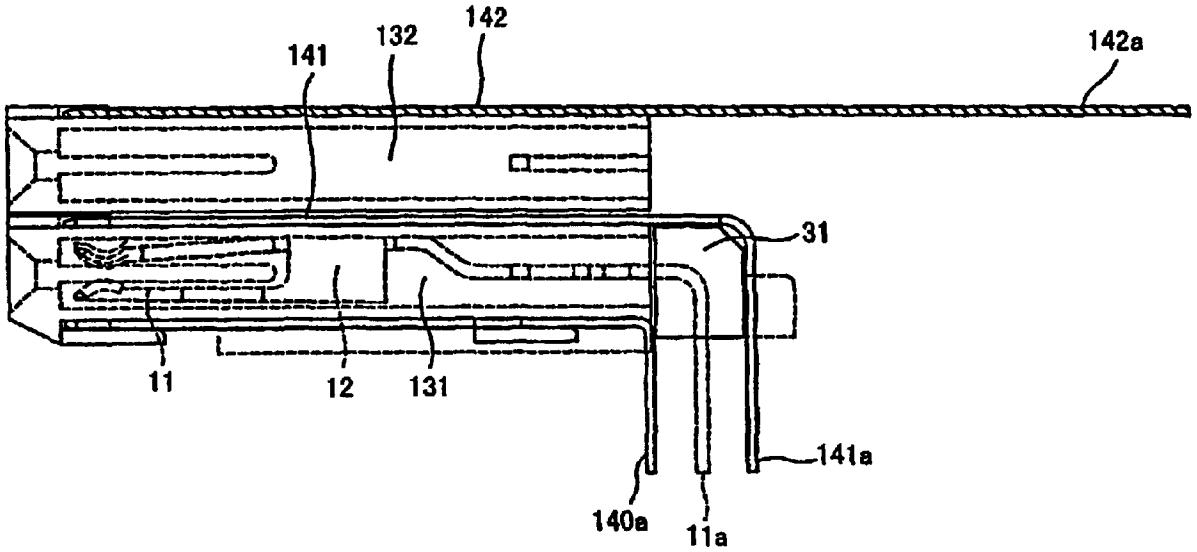
FIG. 13 is a cross-sectional view showing the next assembly step of the plug connector.

As shown in FIG. 12, in the second step, the rear portion 141*a* of the horizontal shield plate 141 on the first housing module 131 is bent downwardly substantially at a right angle. As shown in FIG. 13, in the third step, the second housing module 132 is overlapped on the horizontal shielding plate 141 of the first housing module 131 and coupled with the first housing module. This coupling is carried out by engaging the female engagement portions 18 of the second housing module 132 with the male engagement portions 17 of the first housing module.

Figure 14:
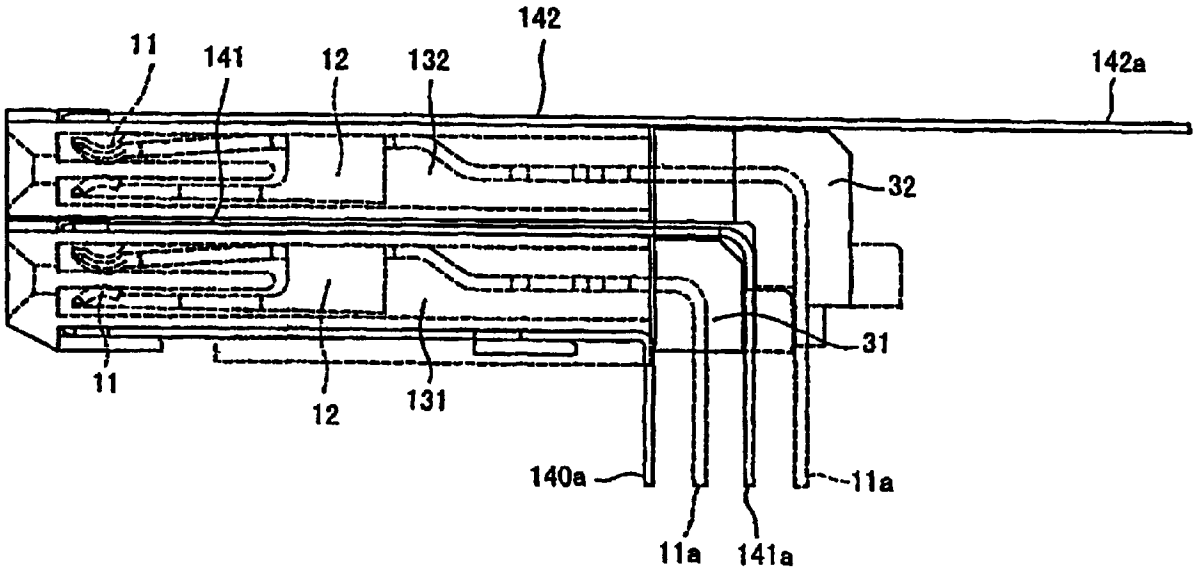
FIG. 14 is a cross-sectional view showing the next assembly step of the plug connector; and, FIG. 15 is a cross-sectional view showing the next assembly step of the plug connector.

As shown in FIG. 13, in the fourth step, the horizontal shielding plate 142 is overlapped on the second housing module 132 and the positioning work is carried out in the same manner as in the case of the horizontal shielding plate 141. Thereafter, as shown in FIG. 14, the second terminal assembly 32 is press inserted from the rear end side of the second housing module 132 for connection thereto.

Figure 15:
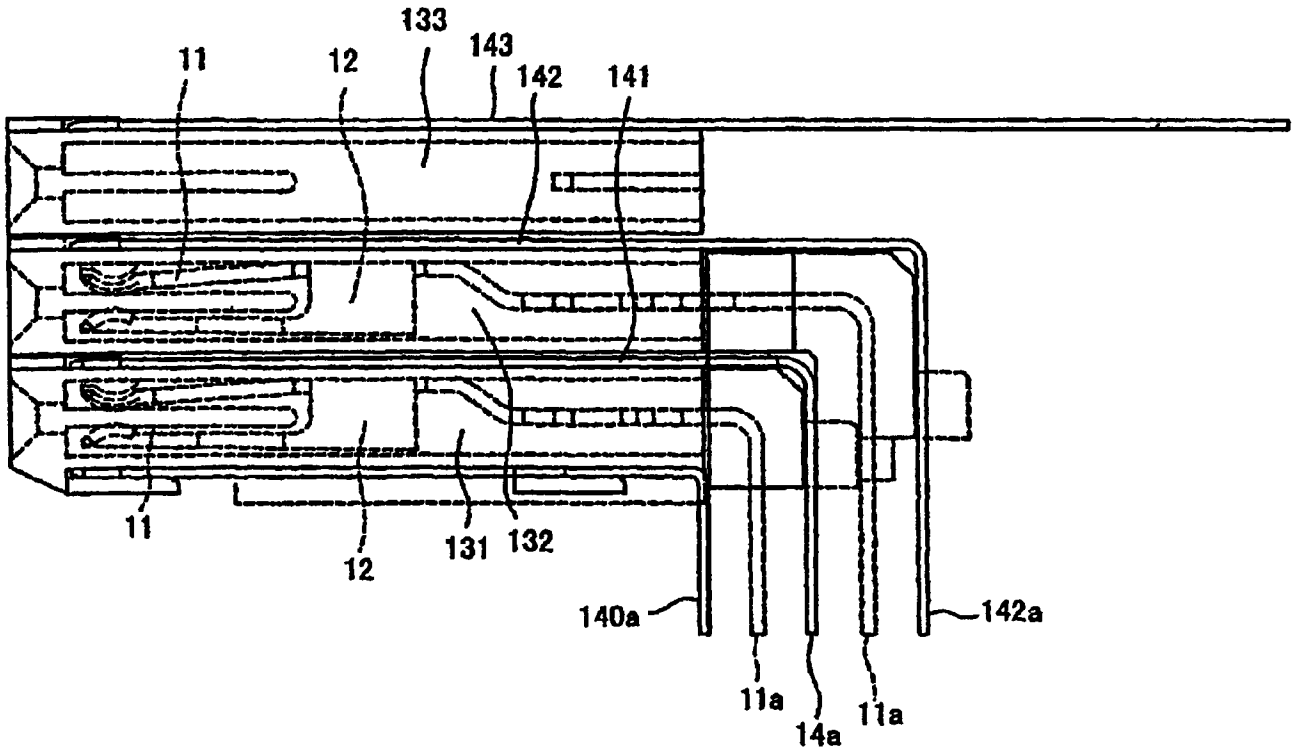

As shown in FIG. 15, in the fifth step, the rear end portion 142*a* of the horizontal shield plate 142 on the second housing module 132 is bent downwardly substantially at a right angle. In the steps onward, as shown in FIG. 15, in the same manner as in the previous steps, the third housing module 133 is overlapped on and coupled with the horizontal shielding plate 142 on the second housing module 132, and the horizontal shielding plate 143 is overlapped and positioned thereon. Thereafter, the works such as connection of the third terminal assembly 33, bending of the rear portion 143*a* of the horizontal shielding plate 143, the coupling between the fourth housing module 134 and the horizontal shielding plate 144, the connection of the terminal assembly 34, and the like are performed finally in order to assemble the plug connector 10 shown in FIG. 8. Incidentally, these assembling steps are possible by manual work but it is preferable to perform the steps by using an automatic machine for assembling.

According to such a method, since a method is adopted in which the upper stage housing module 132 is overlapped on and coupled with the lower stage housing module 131 through the horizontal shielding plate 141, all the terminals 12 in the one lateral row (25 pieces in the case of this embodiment illustrated) may be press inserted simultaneously. Accordingly, the press inserting step of the terminals 12 may correspond with the laminate stages. Since the number of the laminate stages is five, the five times of contact press inserting steps suffice. Thus, it is possible to considerably reduce the steps of press inserting the contacts to thereby enhance the manufacturability and reduce the manufacture cost.

It is preferable that each horizontal shield plate 140 to 145 is provided on each housing module 131 to 135 in advance. Thus, it is possible to reduce the number of the steps of assembling corresponding to this. In the illustrated embodiment, it is also preferable that mounting passages 19 for the terminal assemblies 31 to 35 are arranged at an interval in a widthwise direction of the housing modules 131 to 135 and the slits 19*a* are provided between the adjacent mounting passages 19 as shown in FIG. 1. The slits 19*a* are thus provided between the adjacent mounting holes 19 so that each vertical shielding plate 27 on the receptacle connector 20 side may be inserted into plug connector body portion adjacent the terminal mounting passages 19, and the terminals 12 mounted therein. Thus, an electromagnetic shielding effect may be ensured.

As described above, according to the substrate connecting connector of the present invention, it is possible to solve the problem inherent in the shield of the connector and to obtain the substrate connecting connector where no cross-talk happens. Furthermore, it is possible to enhance the manufacturability while considerably reducing the press inserting step of the contacts and to reduce the manufacture cost.

While the preferred embodiment of the invention have been shown and described, it will be apparent to those skilled in the art that changes and modifications may be made therein without departing from the spirit of the invention, the scope of which is defined by the appended claims.

What is claimed is:

1. A connector for electrically connecting two circuit boards together, comprising:

a plug connector for mounting to the first of the two circuit boards, and a receptacle connector for mounting to the second of said two circuit boards, said receptacle connector including an insulative housing having an opening that receives said plug connector when said plug and receptacle connectors are mated together;

the receptacle connector housing further including a plurality of male conductive terminals arranged in a grid pattern within said receptacle connector housing, and a plurality of conductive vertical shielding plates disposed in said receptacle connector housing in a spaced apart fashion such that adjacent rows of said male terminals are separated from each other by a single one of said vertical shielding plates; and, the plug connector including an insulative housing cooperatively formed from a plurality of distinct housing modules, each of the housing modules supporting a plurality of female conductive terminals, each of the female terminals including contact portions that make electrical contact with corresponding associated male terminals of said receptacle connector when said plug and receptacle connectors are mated together, said plug connector including:

a plurality of conductive horizontal shielding plates are disposed in spaced-apart fashion between adjacent housing modules, the horizontal shielding plates and said housing modules including a plurality of slits aligned with each other to cooperatively form slits that extend vertically between adjacent columns of said plug connector female terminals, said plug connector slits receiving therein said receptacle connector vertical shielding plates in a cruciform manner when said plug and receptacle connectors are mated together.

2. The connector assembly according to claim 1, wherein said plug connector housing modules are overlapped in a plurality of stages in a vertical direction of said housing and are connected to each other, and said horizontal shield plates are interposed between the housing modules, respectively.

3. The connector assembly according to claim 2, wherein each of said housing modules includes a plurality of terminal-receiving passages (19) formed therein and arranged at an interval widthwise, and said slits are disposed between adjacent terminal-receiving passages in said housing modules.

4. The connector assembly according to claim 1, wherein said housing modules include engagement members disposed on opposing surfaces of adjacent housing modules.

5. The connector assembly according to claim 4, wherein said housing module engagement members further engage said horizontal shielding plates between said adjacent housing modules when said housing modules are engaged together.

6. The connector assembly according to claim 5, wherein said housing module engagement members include a projecting lug disposed on top surfaces of said housing modules and a recess disposed on bottom surfaces of said housing modules.

7. The connector assembly according to claim 1, wherein said female terminals include terminal assemblies, each terminal assembly including a contact portion disposed within said terminal-receiving passage, a tail portion for connecting to one of said circuit boards, and an intermediate portion interconnecting said contact and tail portions together, said intermediate portion having an insulative body disposed thereon.

8. The connector assembly according to claim 7, wherein each of said housing modules has substantially the same length and said housing modules are stacked one upon another in a plurality of stages, each of said housing module stages supporting a plurality of said terminal assemblies, said terminal assemblies located in an upper stage of said housing modules being longer than said terminal assemblies located in a lower stage of said housing modules, said terminal assemblies being further bent at their respective tail portions at right angles relative to said contact portions.

9. The connector according to claim 8, wherein said terminal assembly insulative body portions are disposed on vertical portions of said terminal assembly tail portions.

10. A plug connector for mating to a receptacle connector of the type having an insulative housing including a pair of sidewalls that defines an open channel of the receptacle connector therebetween for receiving said plug connector therein when said plug and receptacle connectors are mated together, said receptacle connector further including a plurality of conductive male terminals arranged in a grid pattern within said receptacle connector channel, the grid pattern including rows and columns of said male terminals, said receptacle connector further including a plurality of conductive shielding plates disposed in said receptacle connector channel between adjacent columns of said male terminals, said receptacle connector shielding plates extending vertically within said receptacle connector channel, the plug connector comprising:

a plurality of distinct, horizontal housing modules engaged together to cooperatively define a housing of said plug connector, the plug connector housing being received with said receptacle connector channel when said plug and receptacle connectors are mated together, said housing modules each including a plurality of terminal-receiving passages that support therein a plurality of female conductive terminals, each of the female terminals including contact portions that make electrical contact with corresponding associated male terminals of said receptacle connector when said plug and receptacle connectors are mated together, wherein:

said plug connector further includes a plurality of conductive horizontal shielding plates that are disposed between adjacent housing modules, the horizontal shielding plates and said housing modules include a plurality of slits aligned with each other, the slits cooperatively defining a plurality of recesses of said plug connector that extend vertically between adjacent columns of said female terminals, said recesses being sized to receive therein said receptacle connector vertical shielding plates in a cruciform manner when said plug and receptacle connectors are mated together.

11. The plug connector according to claim 10, wherein each of said housing modules includes at least one lug member disposed on a top surface thereof, and at least one notch member disposed on a bottom surface thereof, said lug member engaging said notch member when two of said housing modules are engaged together.

12. The plug connector according to claim 11, wherein each of said housing modules has a plurality of lug members and notch members associated therewith, said lug and notch members being disposed on opposite surfaces of said housing modules, pairs of said lug and notch members being vertically aligned with said terminal-receiving passages.

13. The plug connector according to claim 11, wherein each of said housing modules further include at least one tab projecting therefrom and said horizontal shielding plates including at least one slot that receive said tabs to retain said horizontal shielding plates in place on said housing modules.

14. The plug connector according to claim 11, wherein each of said horizontal shielding plates includes at least one slot disposed near a front end thereof for engaging said housing module lugs when said horizontal shielding plates are placed upon said housing modules.

* * * * *